US009422092B2

(12) United States Patent
Schütz

(10) Patent No.: US 9,422,092 B2
(45) Date of Patent: Aug. 23, 2016

(54) INNER CONTAINER MADE OF PLASTIC AS WELL AS TRANSPORT AND STORAGE CONTAINER FOR LIQUIDS HAVING SUCH AN INNER CONTAINER

(71) Applicant: Protechna S.A., Fribourg (CH)

(72) Inventor: Udo Schütz, Selters (DE)

(73) Assignee: PROTECHNA S.A., Fribourg (CH)

( * ) Notice: Subject to any disclaimer, the term of this patent is extended or adjusted under 35 U.S.C. 154(b) by 10 days.

(21) Appl. No.: 14/187,004

(22) Filed: Feb. 21, 2014

(65) Prior Publication Data

US 2014/0291356 A1 Oct. 2, 2014

(30) Foreign Application Priority Data

Mar. 28, 2013 (DE) ..... 10 2013 205 688

(51) Int. Cl.

| | |
|---|---|
| ***B65D 77/06*** | (2006.01) |
| ***B65D 19/00*** | (2006.01) |
| ***B65D 61/00*** | (2006.01) |
| ***B65D 25/42*** | (2006.01) |
| *B65D 77/04* | (2006.01) |

(52) U.S. Cl.

CPC ..... *B65D 61/00* (2013.01); *B65D 25/42* (2013.01); *B65D 77/0466* (2013.01); *B65D 77/0453* (2013.01); *B65D 77/061* (2013.01); *B65D 2519/00* (2013.01); *B65D 2519/00034* (2013.01); *B65D 2519/00273* (2013.01); *B65D 2519/00502* (2013.01); *B65D 2519/00815* (2013.01); *Y10S 383/906* (2013.01)

(58) Field of Classification Search

CPC ..... B65D 77/0453; B65D 77/0466; B65D 25/42; B65D 61/00; B65D 2519/00; B65D 2519/00034; B65D 77/061; B65D 2213/02; B65D 19/12; B65D 2519/00273; B65D 2519/00338; B65D 2519/00502; B65D 2519/00805; B65D 2519/00815; B65D 2519/00532; Y10S 383/906

See application file for complete search history.

(56) References Cited

U.S. PATENT DOCUMENTS 3,578,213 A * 5/1971 Clarke ..... B65D 90/047 222/183
3,756,459 A * 9/1973 Bannister ..... G01N 35/08 222/1

(Continued)

FOREIGN PATENT DOCUMENTS

DE 9107212 U1 8/1991
DE 4108399 C1 10/1992

(Continued)

OTHER PUBLICATIONS

European Search Report (Jun. 26, 2014).

*Primary Examiner* — Frederick C Nicolas
(74) *Attorney, Agent, or Firm* — Quarles & Brady LLP

(57) ABSTRACT

An inner container for transporting and storing liquids includes an outlet neck and a bottom wall. The bottom wall connects two side walls, one rear wall and one front wall of the inner container to one another. The outlet neck is arranged in a funnel bottom of an outlet funnel embodied in the bottom wall, and includes one front funnel wall, two lateral funnel walls and one rear funnel wall, wherein the lateral funnel walls are inclined from a lower edge of a side wall towards the funnel bottom in each case, in such a way that the outlet funnel has the shape of a truncated pyramid above the funnel bottom.

27 Claims, 6 Drawing Sheets

(56) References Cited

U.S. PATENT DOCUMENTS

| | | | | | |
|---|---|---|---|---|---|
| 5,100,026 | A * | 3/1992 | Farrell | B65D 88/18 | 222/105 |
| 5,269,414 | A | 12/1993 | D'Hollander | | |
| 5,356,029 | A | 10/1994 | Hogan | | |
| 5,445,289 | A | 8/1995 | Owen | | |
| 5,593,067 | A * | 1/1997 | Shaw | B67C 11/02 | 222/108 |
| 5,746,343 | A * | 5/1998 | Waltke | B65D 19/12 | 206/600 |
| 7,475,796 | B2 * | 1/2009 | Garton | B65D 88/128 | 211/153 |

FOREIGN PATENT DOCUMENTS

| | | | |
|---|---|---|---|
| EP | 0511781 | A1 | 11/1992 |
| FR | 2966810 | A1 | 5/2012 |

* cited by examiner

Fig. 1
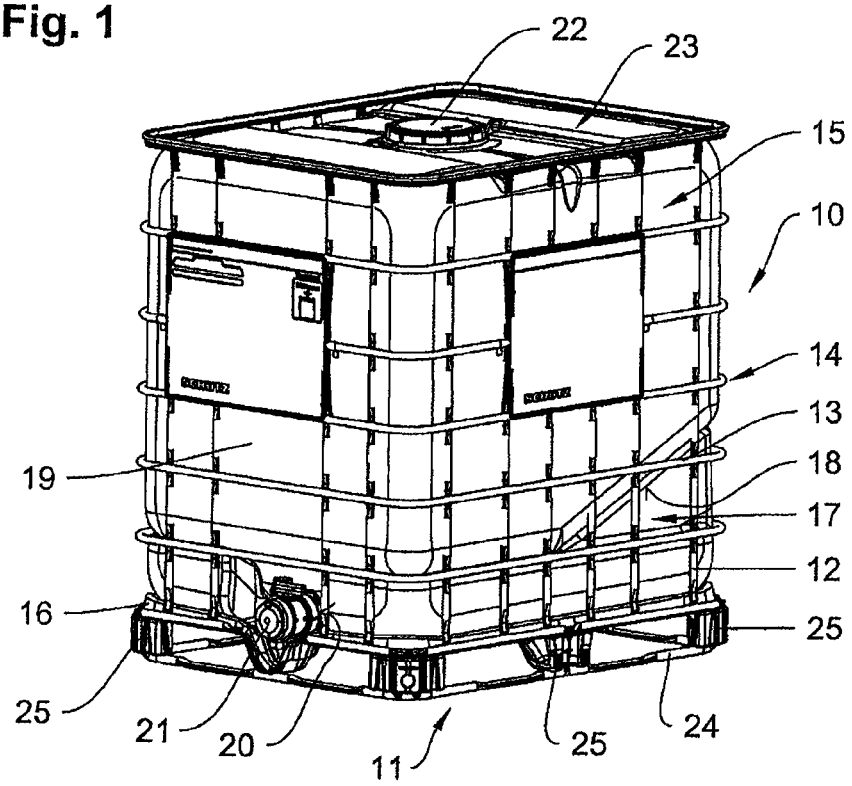
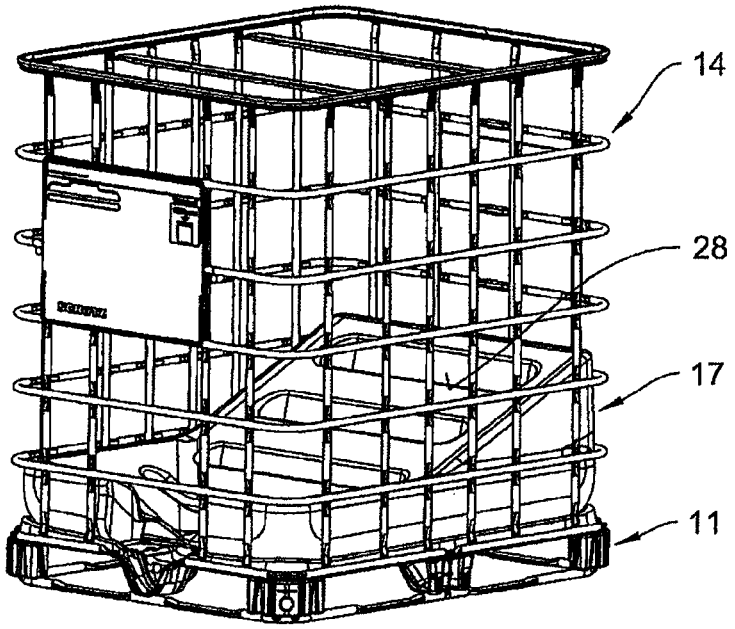
Fig. 2

Fig. 5
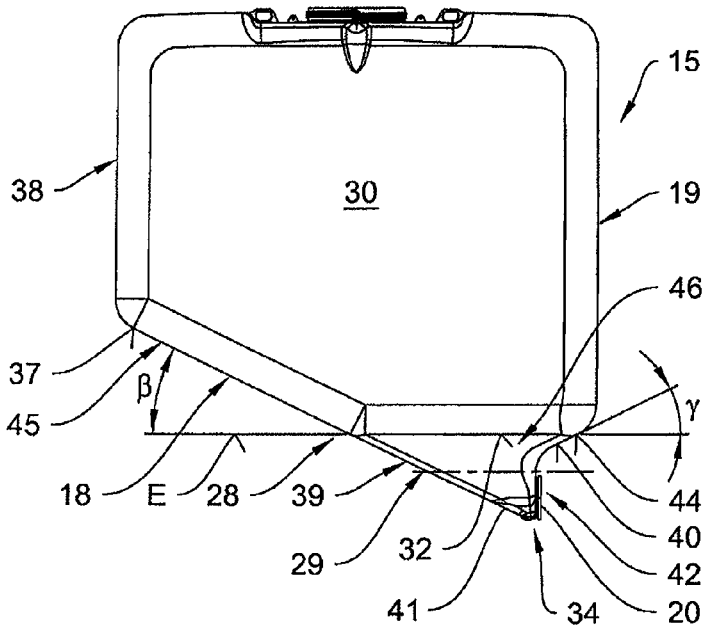
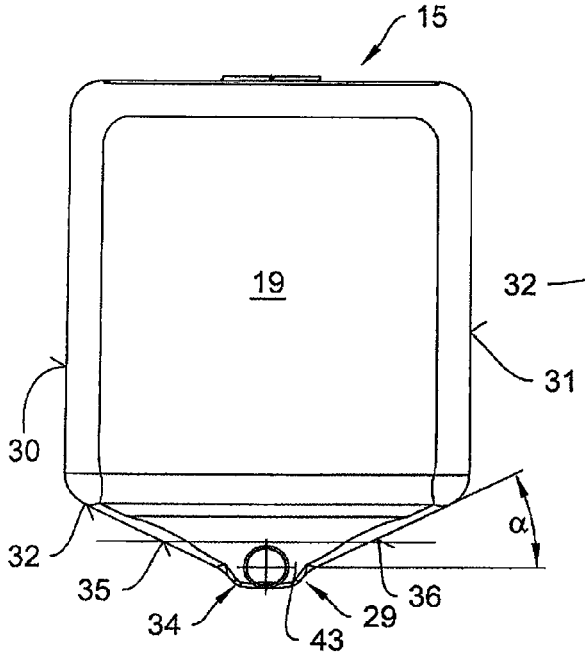
Fig. 6
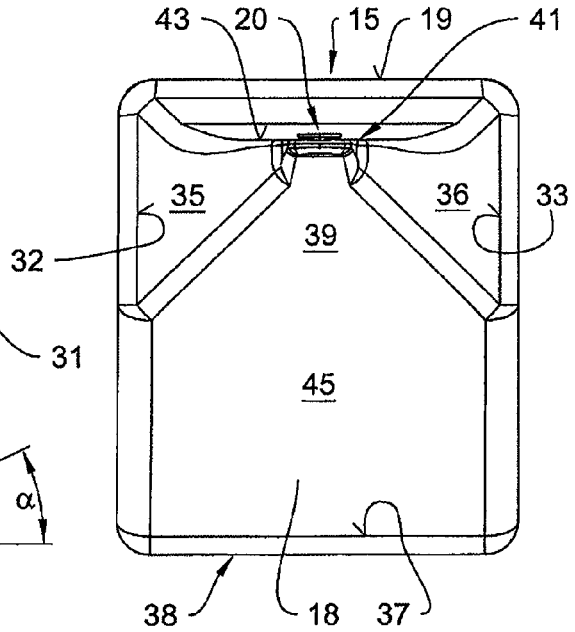
Fig. 7

Fig. 8
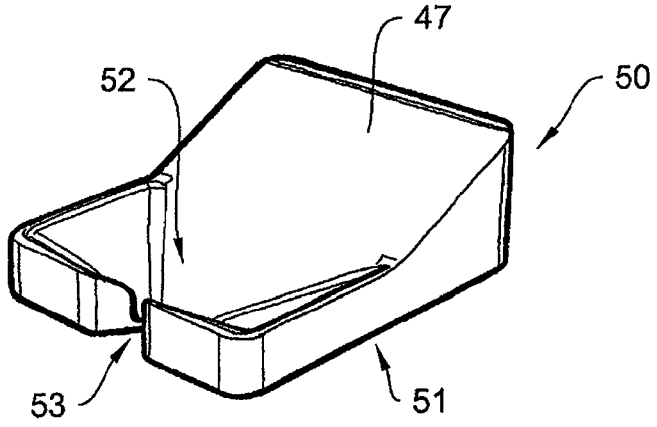
Fig. 9
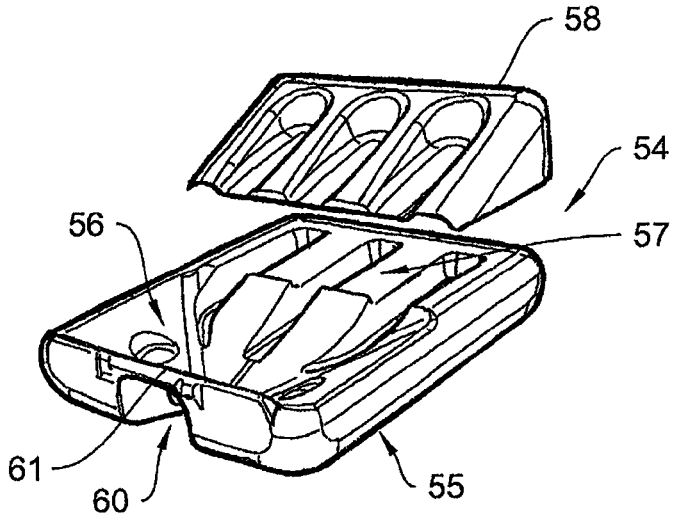
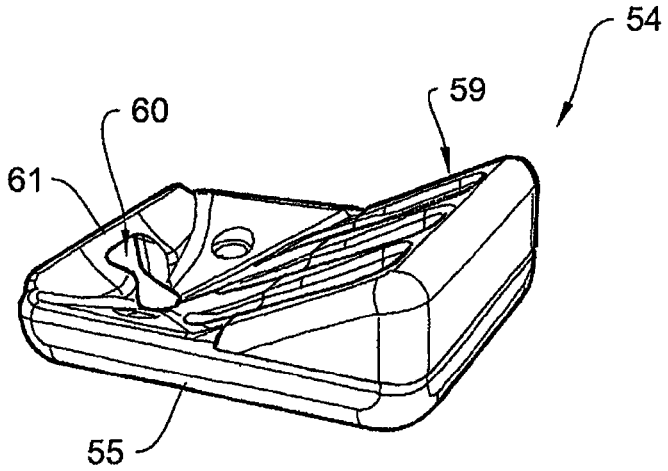
Fig. 10

Fig. 11
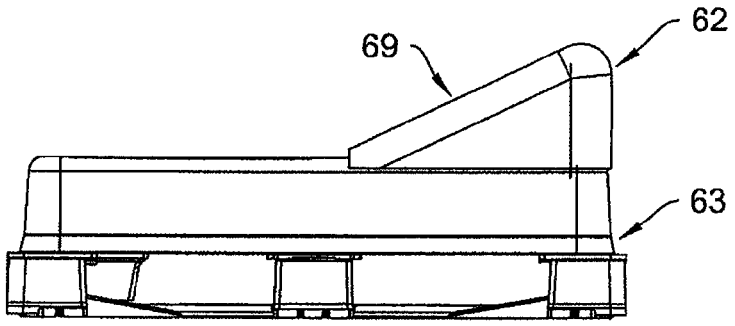
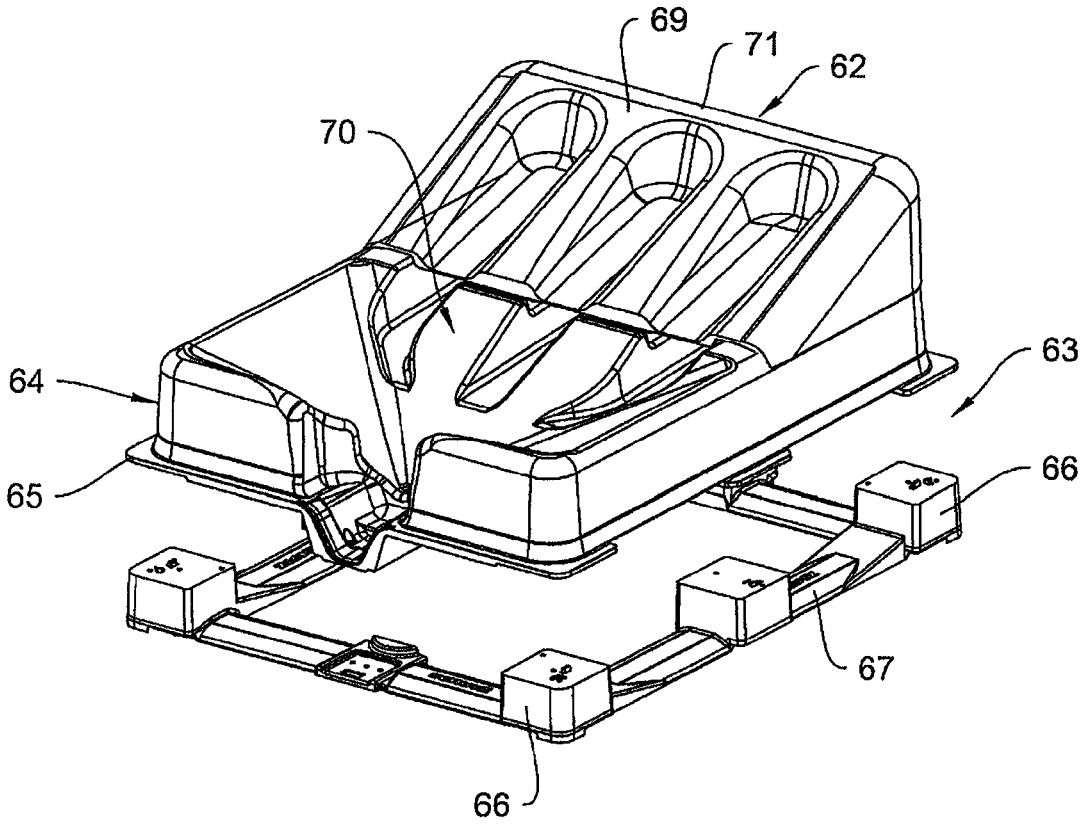
Fig. 12

INNER CONTAINER MADE OF PLASTIC AS WELL AS TRANSPORT AND STORAGE CONTAINER FOR LIQUIDS HAVING SUCH AN INNER CONTAINER

CROSS REFERENCE TO RELATED APPLICATION

The present application claims the benefit of German Patent Application No. 10 2013 205 688.5 filed Mar. 28, 2013, which is fully incorporated herein by reference.

STATEMENT REGARDING FEDERALLY SPONSORED RESEARCH OR DEVELOPMENT

Not applicable.

FIELD OF THE INVENTION

The present invention relates to an inner container made of plastic for transporting and storing liquids, said inner container comprising, at a front side, an outlet neck for connecting an outlet armature and a bottom wall, which connects two side walls, one rear wall and one front wall of the inner container to one another, and which bottom wall is for supporting the inner container on a pallet bottom of a transport pallet that is provided with an outer jacket for accommodating the inner container. Moreover, the invention relates to a transport and storage container having such an inner container.

BACKGROUND OF THE INVENTION

Inner containers of the afore-mentioned type are used as a replaceable component of transport and storage containers, which serve to transport and to store liquids and which are habitually used as so-called "circulatory containers", which are filled repeatedly. So as to allow the highest possible turnover of the fluids filled into the containers, it is important to ensure the most complete draining of the containers, such that the entire container volume is available for the new filling in the next filling operation. In some cases, it is also important to attain the most complete draining of the containers, so as not to have to carry out complicated rinsing and cleaning operations, or to at least limit these operations to a corresponding minimum.

In particular with highly viscous filling materials, which have good wetting properties relative to the inner walls of the inner container, a substantially complete draining of the known inner containers can turn out to be very complicated and time-consuming, since the container shape is substantially oriented toward making a container available having a maximized container volume, which container additionally, in respect of its outer dimensions or its embodiment, is substantially adapted to the accommodating space, which is defined on the transport pallet within the outer jacket.

SUMMARY OF THE INVENTION

The present invention is based on the task of proposing an inner container made of plastic for transporting and storing liquids as well as a transport and storage container having such an inner container, which allows the most complete draining of the residual liquid from the container with the smallest possible effort, even with highly viscous filling materials.

In accordance with the invention, the outlet neck is arranged in a funnel bottom of an outlet funnel which is embodied in the bottom wall, and which comprises four triangular funnel walls, comprising one front funnel wall, two lateral funnel walls and one rear funnel wall, wherein the lateral funnel walls are inclined from a lower edge of a side wall towards the funnel bottom in each case, embodying a truncated pyramid above the funnel bottom together with the rear funnel wall and the front funnel wall.

Due to the embodiment in accordance with the invention, the bottom wall is utilized for embodying an outlet funnel, which is defined by four triangular funnel walls that are preferably flat and which comprises a funnel bottom, in which the outlet neck is arranged. Due to the triangular embodiment of the funnel walls, the outlet funnel has the shape of a truncated pyramid above the funnel bottom, such that the funnel walls provide for a flow profile in the bottom wall of the inner container, which profile continually becomes smaller towards the outlet neck, without liquid pockets being able to be formed when a liquid is drained, which pockets would prevent a complete draining of residual liquid.

Preferably, the front funnel wall is inclined from a lower edge of a front wall towards the funnel ground, such that an arrangement of the outlet neck results, which is recessed with respect to the front wall of the inner container, an arrangement of an outlet armature thus resulting, which is correspondingly recessed and in this way protected, said outlet armature being mounted onto the outlet neck. In addition, the inclined front funnel wall allows an adaptation of the inclination angle of the front funnel wall to the inclination angles of the remaining funnel walls, which means in particular the embodiment of the same inclination angle with all funnel walls.

For a proper functioning of the outlet funnel, it is, however, sufficient if, in accordance with a possible embodiment, the front funnel wall is formed by a triangular extension of the front wall, said extension extending in the plane of the front wall.

If the lower edge of the rear wall, the lower edges of the side walls and the lower edge of the front wall are arranged in a horizontal plane of the inner container, an inner container having a funnel-shaped bottom wall results, with which inner container the front wall, the side walls and the rear wall can be implemented with the same size.

If the lower edge of the rear wall, the lower edges of the side walls and/or the lower edge of the front wall are arranged in different horizontal planes of the inner container, any number of variants of the funnel embodiment is possible, so as to be able to vary the inclination of the funnel walls and the relative position of the funnel ground or of the outlet neck at the inner container.

If the lower edge of the rear wall is arranged above the lower edges of the side walls of the inner container and the lower edges of the side walls are arranged in a horizontal plane together with the lower edge of the front wall, an inner container results, having a relatively small inclination of the rear funnel wall and a large usable holding capacity.

If the lower edge of the rear wall is arranged above the lower edges of the side walls of the inner container and the lower edge of the front wall is arranged between the lower edge of the rear wall and the lower edges of the side walls, an inner container results, having a relatively larger inclination of the rear funnel wall and a comparatively smaller usable holding capacity, wherein said inner container is particularly suitable for liquids having a higher viscosity.

If the lower edge of the rear wall and the lower edge of the front wall are arranged in a horizontal plane and above the lower edges of the side walls, an inner container results, having an even larger inclination of the rear funnel wall and a comparatively even smaller usable holding capacity, wherein said inner container is particularly suitable for liquids having a particularly high viscosity.

Comparable specifics apply to an inner container with which the lower edge of the rear wall is arranged between the lower edge of the front wall and the lower edges of the side walls.

A particularly small flow resistance in the inlet area of the outlet neck is attained if the funnel bottom is embodied to be cup-shaped and comprises a connecting face for the outlet neck, said connecting face being embodied at a lower edge of the front funnel wall and being arranged parallel to the front wall of the inner container.

The transport and storage container for liquids in accordance with the invention comprises an inner container made of plastic having the features described herein, wherein the inner container is arranged, for support, with its bottom wall on a pallet bottom of a transport pallet that is provided with an outer jacket for accommodating the inner container, and wherein a supporting means is arranged between the bottom wall of the inner container and the pallet bottom, said supporting means comprising a supporting surface that is adapted to the bottom wall in respect of its inclination.

The transport and storage container in accordance with the invention, due to a simple combination of a conventional transport pallet, which comprises an outer jacket, with a supporting means, thus makes it possible to use an inner container that has the advantages which are described herein.

The transport and storage container in accordance with the invention makes it possible to use an inner container that allows an improved draining of the residual liquid, without there being the need to deviate from the transport pallet that is usually used with a transport and storage container, or from the outer jacket that is embodied in the usual manner so as to be able to utilize the advantageous effects of the inner container.

It has a particularly advantageous effect with regard to the total height of the transport and storage container if the supporting means, for embodying the supporting surface for the bottom wall, comprises a supporting frame having a recess for the outlet funnel and having a recess for passing through an outlet armature that is arranged at the outlet neck, such that the outlet funnel can be accommodated in the supporting means in a manner being retracted.

Preferably, the supporting frame comprises a supporting brace for supporting the inner container, said supporting brace bridging the recess for passing through the outlet armature that is arranged at the outlet neck.

If, in accordance with an advantageous embodiment, the supporting means, for embodying the supporting surface for the bottom wall, comprises a supporting ramp in a rear section of the supporting frame, a particularly safe support of an inner container is possible, said inner container comprising a bottom wall that is inclined from the lower edge of the rear wall towards the funnel bottom.

If the supporting ramp is formed, at least partly, from a supporting top that is arranged on a supporting base of the supporting frame, the best possible adaptation of the supporting means to inner containers having different bottom walls can be attained with a small effort, based on a ready-to-use embodiment of an elementary form of the supporting means, by adding an individual supporting superstructure.

For reducing the number of components of a transport and storage container, the supporting frame can be embodied to be linked to the pallet bottom in one piece, which means, for example, as a molded part.

It is particularly advantageous if the supporting means is embodied, at least partly, as a blow molded part, such that the same technology can be used for producing the supporting body and for producing the inner container.

It is in particular advantageous if the supporting frame is embodied as a blow molded part, thus allowing to be easily adapted, in respect of its shaping, to the bottom wall or to the outlet funnel of the bottom wall.

If the supporting frame and the supporting top are embodied as blow molded parts, the two components can be produced in a common production process.

It is alternatively possible to embody the supporting means, at least partly, as an injection molded part.

If the supporting means is embodied at least partly as an injection molded part, there is the advantage that the supporting means can be implemented, due to an optimized design, with the smallest amount of material used possible and, nevertheless, having a high dynamic load capacity.

If the supporting frame is embodied as an injection molded part, the same cannot only be easily adapted to the bottom wall or to the outlet funnel of the bottom wall in respect of its shaping, but also has a particularly high stability.

If the supporting frame and the supporting top are embodied as injection molded parts, the two components can be produced in a common production process.

In particular for producing a supporting means, which is composed of simple flat parts, nevertheless allowing an adaptation to the surface of the pallet bottom as well as to the bottom wall as well as to the outlet funnel of the inner container, it is advantageous if the supporting means is embodied as a framework having a plurality of supporting ribs which are arranged transversely to the longitudinal direction of the inner container, and which are connected to one another via horizontal connection elements.

If the supporting means is embodied as a bar framework having a plurality of bars that are connected to one another, it is, for example, possible to implement the supporting means as a welded construction, wherein it turns out to be advantageous in particular to use tubes due to their high bending resistance as compared to the amount of material used.

If the bar framework is formed, at least partially, by bars of the outer jacket, the amount of material used for producing the bar framework can be minimized by using bars of the outer jacket which already exist.

For preventing an undesirable surface pressure at the contact points between the bars of the bar framework and the inner container, it is advantageous if the bar framework, for embodying supporting surfaces, is provided with load-bearing surfaces, which are preferably formed from pieces of sheet metal, such that welding to the bars of the bar framework is easily possible.

Preferred embodiments of the inner container in accordance with the invention and of the transport and storage container in accordance with the invention will be defined in more detail below by means of the drawing.

BRIEF DESCRIPTION OF THE DRAWINGS

In the figures:

FIG. 1 shows a transport and storage container having an inner container which is arranged on a supporting means;

FIG. 2 shows the supporting means which is arranged on a transport pallet of the transport and storage container that is illustrated in FIG. 1;

FIG. 5 shows the inner container that is illustrated in FIG. 3 in a side view;

FIG. 6 shows the inner container that is illustrated in FIG. 3 in a front view;

FIG. 7 shows the inner container that is illustrated in FIG. 3 in a view from below;

FIG. 8 shows a supporting means which is embodied as an injection molded part;

FIG. 9 shows a supporting means which is produced as a blow molded part, and which is embodied in two parts, in an exploded view;

FIG. 10 shows the supporting means that is illustrated in FIG. 9 in a mounted state;

FIG. 11 shows a supporting means having a pallet bottom, which is integrally embodied, in a side view;

FIG. 12 shows the supporting means that is illustrated in FIG. 11 in an isometric illustration;

DETAILED DESCRIPTION OF THE EXAMPLE EMBODIMENTS

Figure 3:
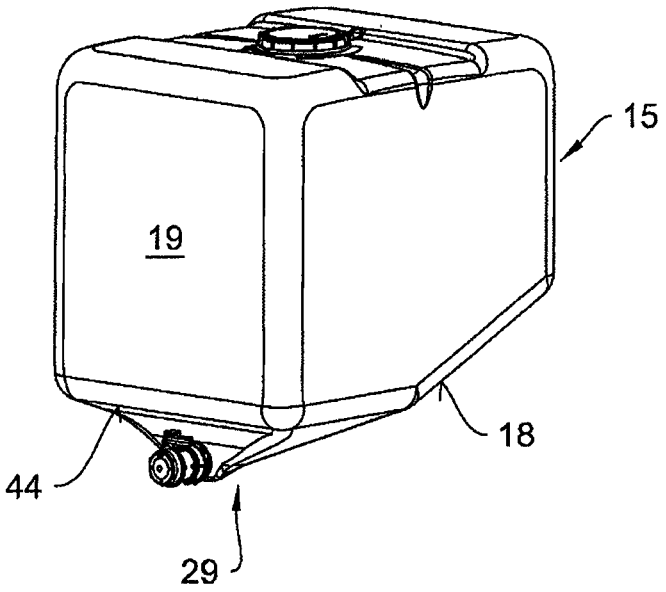
FIG. 3 shows the inner container that is illustrated in FIG. 1 in an individual illustration.

FIG. 1 shows a transport and storage container 10 that accommodates an inner container 15 made of plastic on a transport pallet 11 in an outer jacket 14, which is herein embodied as a grid jacket having vertical bars 12 and horizontal bars 13. A supporting means 17 is arranged between the inner container 15 and a pallet bottom 16 of the transport pallet 11, on which supporting means the inner container 15 is supported with a bottom wall 18. The inner container 15 comprises, at a front wall 19, an outlet neck 20 for connecting an outlet armature 21 that makes it possible to tap a filling material from the inner container 15, said filling material previously having been filled in through a filling opening 22 at an upper side 23 of the inner container 15.

The transport pallet 11 of the transport and storage container 10 that is illustrated in FIG. 1 is implemented as a frame pallet having a base frame 24 which is formed from a tube material, and on which supporting feet 25 are arranged, which support the pallet bottom 16 on which the outer jacket 14 is arranged.

Deviating from the transport pallet 11 that is illustrated in FIG. 1 and is implemented as a frame pallet, the transport pallet can also be implemented as a skid pallet, wherein deviating materials can also be used for the individual components of the pallet, in particular with the skid pallets. It is in particular also conceivable, deviating from the transport pallet 11 which is illustrated in FIG. 1, and which comprises a pallet bottom 16 that is implemented as a molded part of sheet metal, to implement the pallet bottom as a plastic part.

Figure 4:
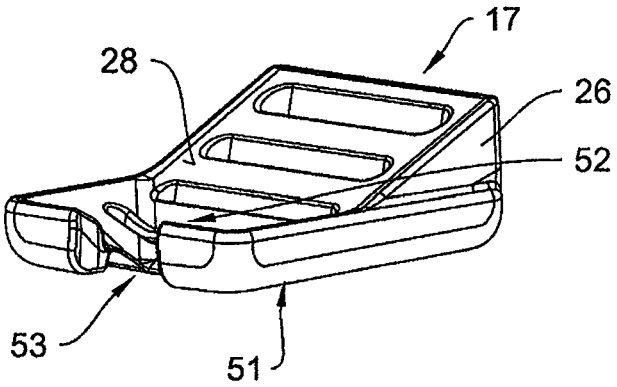
FIG. 4 shows the supporting means that is illustrated in FIGS. 1 and 2 in an individual illustration.

The supporting means 17 which is arranged on the pallet bottom 16, as can in particular be seen from the FIGS. 1, 2 and 4, comprises a supporting ramp 26 in a rear section of a supporting frame 51. The supporting frame 51, in a front section, is provided with a recess 52 for the outlet funnel 29 and with a recess for the outlet armature 21.

As it becomes clear in particular from a combined view of the FIGS. 3 and 4, a surface of the supporting means 17, which faces the bottom wall 18 of the inner container 15, forms a supporting surface 28 which serves for resting, in a supporting manner, against the bottom wall 18 of the inner container 15 as well as for resting against an outlet funnel 29, which is arranged below a lower edge 44 of the front wall 19.

As is shown in particular by the FIGS. 5 to 7, the inner container 15 comprises side walls 30, 31 which comprise, in a manner adjoining the front wall 19 of the inner container 15, lower edges 32, 33 which preferably run horizontally. Triangular lateral funnel walls 35, 36 extend from the lower edges 32, 33, having an inclination angle $\alpha$ relative to a funnel bottom 34 of the outlet funnel 29 which is embodied in the bottom wall 18. In addition, a bottom section 45 of the bottom wall 18, said bottom section preferably being flat, extends from a lower edge 37 of a rear wall 38 of the inner container 15 at an inclination angle $\beta$ towards the funnel bottom 34, wherein the bottom section 45 merges into a rear funnel wall 39, in a manner adjoining the lateral funnel walls. A further funnel wall 40, which comprises an inclination angle $\gamma$ in the case of the illustrated exemplary embodiment, extends from the lower edge 44 of the front wall 19 towards the funnel bottom 34, complementing the two lateral funnel walls 35, 36 and the rear funnel wall 39 above the funnel bottom 34, in which the outlet neck 20 is located, so as to form a truncated pyramid 46.

In the case of the illustrated exemplary embodiment, the inclination angles $\alpha$, $\beta$, $\gamma$ are embodied with the same size, constituting an angle between 20 and 30°, preferably 26°. In addition, the lower edges 32, 33 of the side walls 30, 31 and the lower edge 27 of the front wall 28 are located in a common horizontal plane E, whereas the lower edge 37 of the rear wall 38 is arranged above the lower edges 32, 33 of the side walls 30, 31.

The funnel bottom 34 is embodied to be cup-shaped, having a connecting face 43 for the outlet neck 20, said connecting face being embodied in a lower edge area 42 of the front funnel wall 40 and being arranged parallel to the front wall 19 of the inner container 15.

As it results from the above explanations referring to the FIGS. 5 to 7, the outlet funnel 29, above the funnel bottom 34, is embodied in the shape of a truncated pyramid 46 due to the four triangular funnel walls 35, 36, 39 and 40, wherein the cup-shaped funnel bottom 41 embodies a pyramid top, which is shifted towards the front wall 19.

Depending on whether the inclination angles of the funnel walls are embodied to correspond to or differ from one another, a regular truncated pyramid, which is straight or sloping, results as the shape of the outlet funnel.

Deviating from the embodiment of a supporting means 17, which embodiment is illustrated in FIG. 4, said supporting means being embodied in one piece as a blow molded part, FIG. 8 shows a supporting means 50 which is embodied as an injection molded part, in particular as an injection molded part that is produced from an EPS foam. Consistently with the supporting means 17 (FIG. 4), the supporting means 50 comprises a supporting frame 51 having a recess 52 for accommodating the outlet funnel 29 which is illustrated in FIG. 3, which recess being joined with a further recess 53 for passing through the outlet armature 21 that is arranged at the outlet neck 20 of the inner container 15 as illustrated in FIG. 3. In a rear section of the supporting means 50, a supporting ramp 47 is embodied which is molded to the supporting frame 51 in one piece.

In FIGS. 9 and 10, a supporting means 54 is illustrated, which is embodied as a blow molded part and in two pieces, wherein a supporting frame 55, in a front section, comprises a recess 56 for accommodating the outlet funnel 29 (FIG. 3) and is provided with a supporting base 57 in its rear section, said supporting base embodying a supporting ramp 59, being complemented by the second part of the supporting means 54, which is embodied as a supporting top 58 forming part of a supporting superstructure. For supporting the inner container 15 above a recess 60 for passing through the outlet armature 21, which recess is embodied in the supporting frame 55, the recess 60 is bridged with a supporting brace 61.

In FIGS. 11 and 12, a supporting means 62 is illustrated, which is embodied as a component of a transport and storage pallet 63, having a supporting frame 64 which, as it can in particular be seen from the exploded illustration in FIG. 12, embodies a pallet bottom 65 of the transport and storage pallet 62 in a lower area which is molded thereto in one piece, said pallet bottom being connected to a base frame 67 via supporting feet 66, thus forming the transport and storage pallet 63 which is realized as a frame pallet.

For embodying a supporting ramp 69, the supporting frame 64 is provided with a supporting base 70, in a manner comparable to the supporting frame 55 that is illustrated in FIG. 10 and belongs to the supporting means 54, on which supporting base a supporting top 71 forming part of a supporting superstructure is arranged as the second part of the supporting means 62.

Figure 13:
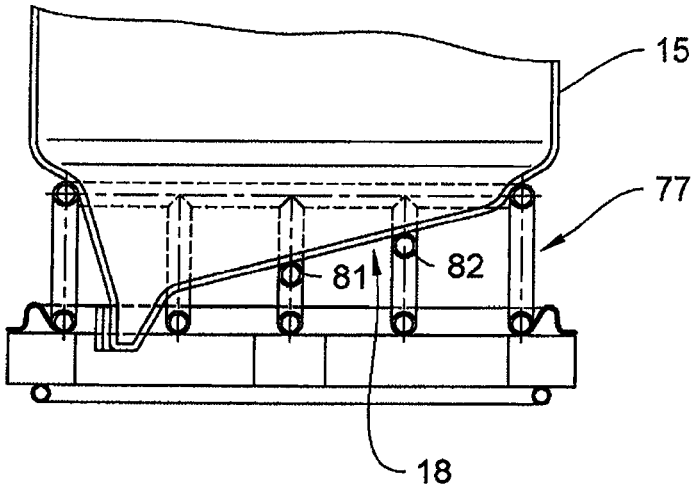
FIG. 13 shows an inner container which is arranged on a supporting means that is embodied as a bar framework.
Figure 14:
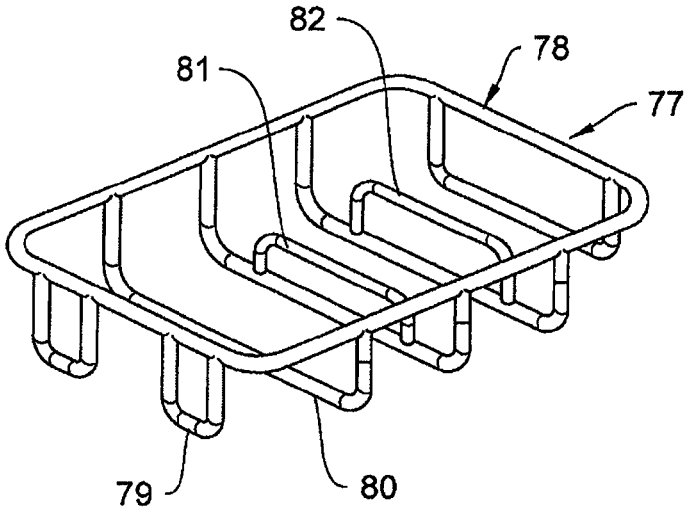
FIG. 14 shows an isometric illustration of the supporting means that is illustrated in FIG. 13.
Figure 15:
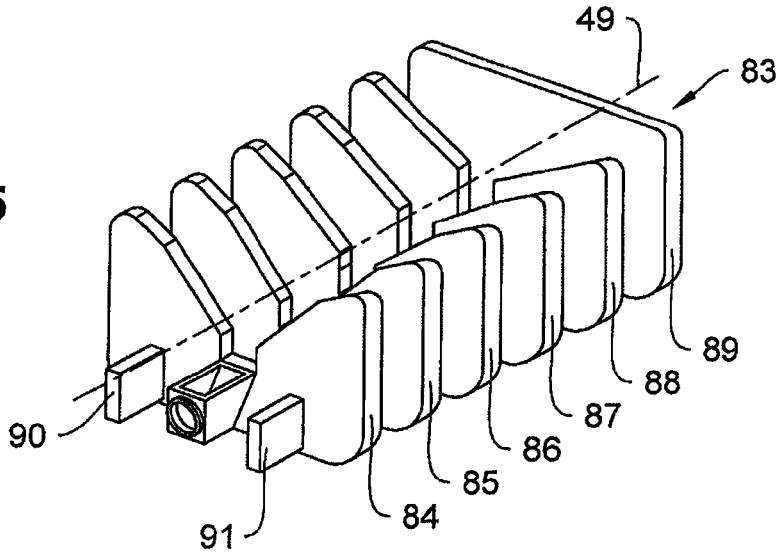
FIG. 15 shows an isometric illustration of a further embodiment of a supporting means.

Deviating from the supporting means 50, 54 and 62 which are illustrated in the FIGS. 8 to 12, and which are produced as blow molded parts or as injection molded parts, the FIGS. 13 to 15 show further possible embodiments by way of example.

For example, FIGS. 13 and 14 show a supporting means 77, which is formed as a bar framework having a closed frame 78 and bars 79, 80 which are connected to the frame 78 and bent in the shape of a U, and which bars 79, 80 consist of tube sections that are formed differently.

As is in particular shown by the FIG. 13, at the bars 80, supporting bars 81, 82 are envisaged, which embody bar bridges for supporting the bottom wall of the inner container 15, being implemented with different heights corresponding to the inclination of the bottom wall 18.

FIG. 15 shows, as a further possible embodiment, a supporting means 83 which is embodied as a framework having a plurality of supporting ribs 84 to 89 which are arranged transversely to a longitudinal axis 49, and which are connected among one another via horizontal connection elements 90, 91 and are secured in their relative arrangement. Here, the respective height or shaping of the supporting ribs 84 to 89 is selected such that an adaptation to the inclined bottom wall 18 of the inner container 15 (FIG. 13) becomes possible.

The invention claimed is:

1. An inner container made of plastic for transporting and storing liquids, said inner container comprising:

an outlet neck for connecting an outlet armature; and a bottom wall connecting a rear wall, a front wall, and two side walls of the inner container, said bottom wall for supporting the inner container on a pallet bottom of a transport pallet provided with an outer jacket accommodating the inner container, the outlet neck being arranged in a funnel bottom of an outlet funnel embodied in the bottom wall, said outlet funnel including one front funnel wall, two lateral funnel walls and one rear funnel wall, wherein each lateral funnel wall is inclined from a lower edge of one of the side walls towards the funnel bottom defining a truncated pyramid above the funnel bottom, in which the front funnel wall is formed by a triangular extension of the front wall, said extension extending in the plane of the front wall.

2. An inner container made of plastic for transporting and storing liquids, said inner container comprising:

an outlet neck for connecting an outlet armature; and a bottom wall connecting a rear wall, a front wall, and two side walls of the inner container, said bottom wall for supporting the inner container on a pallet bottom of a transport pallet provided with an outer jacket accommodating the inner container, the outlet neck being arranged in a funnel bottom of an outlet funnel embodied in the bottom wall, said outlet funnel including one front funnel wall, two lateral funnel walls and one rear funnel wall, wherein each lateral funnel wall is inclined from a lower edge of one of the side walls towards the funnel bottom defining a truncated pyramid above the funnel bottom, in which the funnel bottom is cup-shaped and includes a connecting face for the outlet neck, said connecting face being at a lower edge of the front funnel wall and parallel to the front wall of the inner container.

3. The inner container according to claim 2, in which the front funnel wall is inclined from a lower edge of the front wall towards the funnel bottom.

4. The inner container according to claim 2, in which a lower edge of the rear wall, lower edges of the side walls and a lower edge of the front wall are arranged in a horizontal plane of the inner container.

5. A transport and storage container for liquids having an inner container made of plastic according to claim 2, wherein the inner container is arranged, for support, with the bottom wall on the pallet bottom of the transport pallet that is provided with the outer jacket accommodating the inner container, and wherein a supporting surface is arranged between the bottom wall of the inner container and the pallet bottom.

6. The transport and storage container according to claim 5, in which the supporting surface includes a supporting frame having a recess accommodating the outlet funnel and having a recess passing through the outlet armature arranged at the outlet neck.

7. The transport and storage container according to claim 6, in which the supporting frame includes a supporting brace supporting the inner container, said supporting brace bridging the recess passing through the outlet armature arranged at the outlet neck.

8. The transport and storage container according to claim 6, in which the supporting surface for the bottom wall includes a supporting ramp in a rear section of the supporting frame.

9. The transport and storage container according to claim 8, in which the supporting ramp is formed, at least proportionately, from a supporting superstructure arranged on a supporting base of the supporting frame.

10. The transport and storage container according to claim 6, in which the supporting frame is embodied to be linked to the pallet bottom in one piece.

11. The transport and storage container according to claim 5, in which the supporting surface is, at least proportionately, a blow molded part.

12. The transport and storage container according to claim 6, in which the supporting frame is a blow molded part.

13. The transport and storage container according to claim 5, in which a supporting superstructure is arranged on a supporting base of a supporting frame forming part of the supporting surface, wherein the supporting frame and the supporting superstructure are blow molded parts.

14. The transport and storage container according to claim 5, in which the supporting surface is, at least proportionately, an injection molded part.

15. The transport and storage container according to claim 6, in which the supporting frame is an injection molded part.

16. The transport and storage container according to claim 5, in which a supporting superstructure is arranged on a supporting base of a supporting frame forming part of the supporting surface, wherein the supporting frame and the supporting superstructure are injection molded parts.

17. The transport and storage containers according to claim 5, in which the supporting surface is a load-bearing framework having a plurality of load-bearing ribs arranged transversely to a longitudinal axis of the inner container, and which are connected to one another via horizontal connection elements.

18. The transport and storage container according to claim 5, in which the supporting surface is a bar framework having a plurality of bars that are connected to one another.

19. The transport and storage container according to claim 18, in which the bars are tubes.

20. The transport and storage container according to claim 18, in which the bar framework is formed, at least partially, by bars of the outer jacket.

21. The transport and storage container according to claim 18, in which the bar framework is provided with load-bearing surfaces forming the supporting surface.

22. The transport and storage container according to claim 21, in which the load-bearing surfaces are formed from at least one piece of sheet metal.

23. An inner container made of plastic for transporting and storing liquids, said inner container comprising:

an outlet neck for connecting an outlet armature; and a bottom wall connecting a rear wall, a front wall, and two side walls of the inner container, said bottom wall for supporting the inner container on a pallet bottom of a transport pallet provided with an outer jacket accommodating the inner container, the outlet neck being arranged in a funnel bottom of an outlet funnel embodied in the bottom wall, said outlet funnel including one front funnel wall, two lateral funnel walls and one rear funnel wall, wherein each lateral funnel wall is inclined from a lower edge of one of the side walls towards the funnel bottom defining a truncated pyramid above the funnel bottom, in which at least one of a lower edge of the rear wall, lower edges of the side walls and a lower edge of the front wall are arranged in different horizontal planes of the inner container.

24. The inner container according to claim 23, in which the lower edge of the rear wall is arranged above the lower edges of the side walls of the inner container and the lower edges of the side walls are arranged in a horizontal plane together with the lower edge of the front wall.

25. The inner container according to claim 23, in which the lower edge of the rear wall is arranged above the lower edges of the side walls of the inner container and the lower edge of the front wall is arranged between the lower edge of the rear wall and the lower edges of the side walls.

26. The inner container according to claim 23, in which the lower edge of the rear wall and the lower edge of the front wall are arranged in a horizontal plane and above the lower edges of the side walls.

27. The inner container according to claim 23, in which the lower edge of the rear wall is arranged between the lower edge of the front wall and the lower edges of the side walls.

* * * * *